United States Patent [19]

Koschinek et al.

[11] 4,436,688

[45] Mar. 13, 1984

[54] PROCESS FOR MELT-SPINNING OF SYNTHETIC POLYMERS

[75] Inventors: Gunter Koschinek, Dietzenbach; Dietmar Wandel, Hanau; Bernd Kretschmann, Kahl; Rolf Zinsser, Heusenstamm, all of Fed. Rep. of Germany

[73] Assignee: Davy McKee Aktiengesellschaft, Fed. Rep. of Germany

[21] Appl. No.: 253,780

[22] Filed: Apr. 13, 1981

[30] Foreign Application Priority Data

Sep. 29, 1980 [DE] Fed. Rep. of Germany ..... 3036683

[51] Int. Cl.[3] ..... D01D 5/08

[52] U.S. Cl. ..... 264/176 F; 264/237; 425/72 S

[58] Field of Search ..... 264/176 F, 237; 425/72 S

[56] References Cited

U.S. PATENT DOCUMENTS 4,134,882 1/1979 Frankfort et al. ..... 264/176 F

FOREIGN PATENT DOCUMENTS 48-56913 8/1973 Japan ..... 264/237
51-46853 12/1976 Japan ..... 264/237
52-15614 2/1977 Japan ..... 264/237
52-77228 6/1977 Japan ..... 264/237
53-31815 3/1978 Japan ..... 264/237
53-9293 4/1978 Japan ..... 264/237
53-126314 11/1978 Japan ..... 264/237

*Primary Examiner*—Jay H. Woo
*Attorney, Agent, or Firm*—Allegretti, Newitt, Witcoff & McAndrews, Ltd.

[57] ABSTRACT

An improved process and apparatus for the melt-spinning of synthetic polymers are disclosed. The process and apparatus are preferably adapted to polymers such as polyamide 6, polyamide 66, polyester and their copolymers. The polymers are melt-spun in a spinneret and the resulting filaments are withdrawn at a speed between 600 and 6000 meters/min. The distance between the uppermost blow point of the cooling zone and the spinneret surface is selected so that the distance is within a range, the upper limit of which is defined by the relation B and the lower limit is defined by one of the relations $A_1$ or $A_2$ or $A_3$ as follows:

$$B=48.2\ (\log v)-109\ (\text{mm})$$

$$A_1=34.4\ (\log v)-71\ (\text{mm})$$

$$A_2=-32\ (\log v-3.356)^2+34\ (\text{mm})$$

$$A_3=-44\ (\log v-3.221)^2+32\ (\text{mm}),$$

where v is the spinning withdrawal speed in meters/min.

6 Claims, 3 Drawing Figures

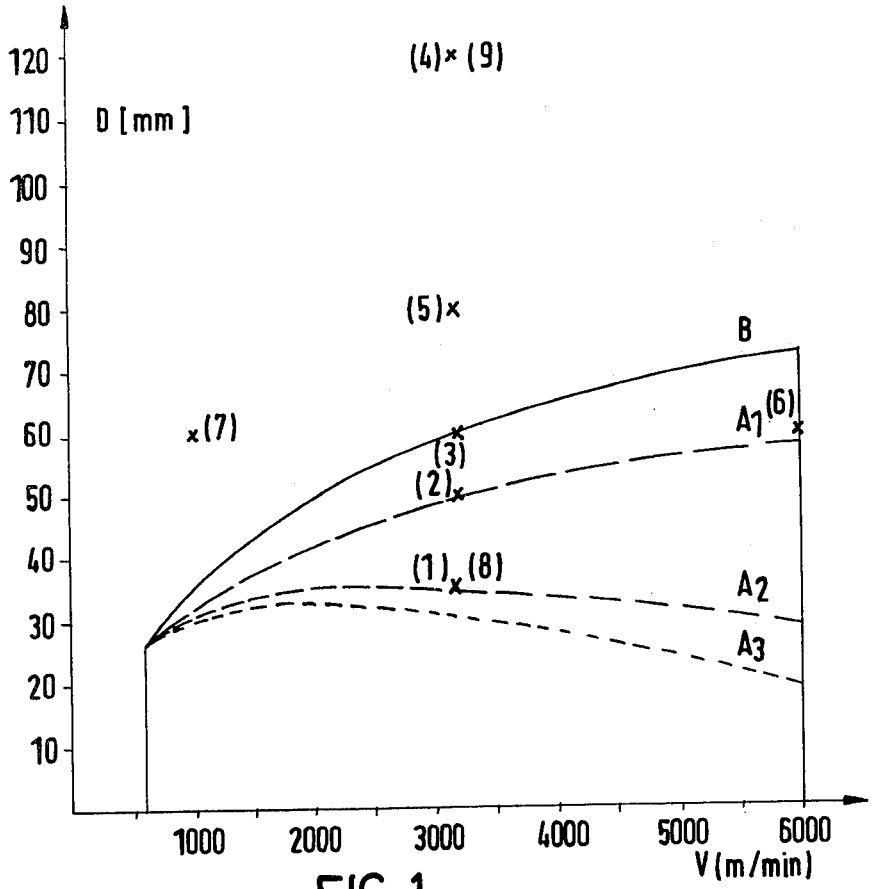
FIG. 1
FIG. 2
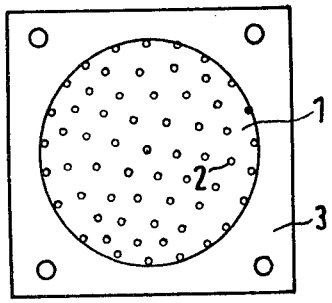
FIG. 3
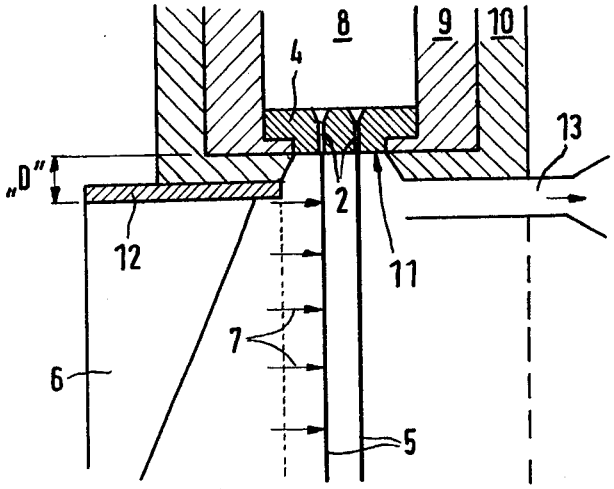

PROCESS FOR MELT-SPINNING OF SYNTHETIC POLYMERS

BACKGROUND OF THE INVENTION

The invention relates to a process and an apparatus for melt-spinning of synthetic polymers, preferably of the group comprising polyamide-6, polyamide-66 and polyester and their copolymers, to produce filaments. The polymers are melt-spun through orifices in a spinneret having a substantially planar bottom surface, and the filaments so formed are cooled in a cooling zone located below the uppermost blow point by subjecting them to an air current. The filaments are subsequently moistened and prepared, and finally withdrawn at a speed ranging from 600 to 6000 meters/minute.

Such melt-spinning processes are widely used in the industry. The processing speeds may vary within a wide range. While filaments produced at speeds of under 1800 m/min are drawn and perhaps also textured in separate steps, so-called high speed spun yarns, i.e. filaments or yarns produced at withdrawal speeds in excess of 1800 m/min, are usually draw-textured in one simultaneous operation because of the higher spinning orientation occuring in the filament, or they may be used as completely oriented filaments directly in subsequent textile operations.

In melt-spinning, the course of the cooling process of the filament strands between their point of emergence from the spinneret orifices and the winding package has a decisive influence on the properties of the yarn, such as titre, or tex, and dyeability uniformity, tenacity and extension characteristics.

The filaments emerging from the spinneret orifices at a temperature above the melting point must be cooled to a temperature below the adhesion point, i.e. below the glass transition point of the polymer, before they can be brought into contact with mechanical guide elements. During the cooling period, the filaments experience a considerable reduction in diameter until a final value is reached which corresponds to the spin titre or tex. Hamana, in his article entitled "The Course of Filament Formation in Melt-Spinning," Melliand 4 (1969), pp. 382–388, describeds how the properties of the filaments change during the period the filaments are in the cooling zone.

Fourne, in his article entitled "Filament Cooling in Melt-Spinning," Chemiefasern/Textilindustrie, April 1978, p. 315, sets forth mathematical relations which point out the influence of the spinning parameters on the uniformity of the filament properties, in particular the titre, or tex, uniformity.

In theory, titre or tex variations diminish as the withdrawal rate increases. However, the withdrawal speed is dependent on a number of other technological considerations such as, for example, plant capacity and cooling capacity, so that it is not available as a freely variable parameter. Rather, experience has shown that, in both low speed spinning as well as high speed spinning, intolerably high titre variations may occur.

It has further been postulated theoretically that titre variations are a function of the sum of twice the thickness of the insulating jacket of the spinning head and the length of the path in the cooling zone where the filaments are subjected to a blown air current. In the instant case, the thickness of the spinning head insulation is the extent by which the spinning head insulation projects in the downward direction from the underside of the spinneret plate. This is a region which is not reachable by the blown air current. However, since the thickness of the insulating jacket of the spinning head is less than the length of the path traversed by the filaments in the air cooling zone, the thickness value of the insulation is considered to be of only secondary influence. Of a much more critical character seems to be the effect of the air current blown at the filaments and the constancy of the blown air current setup.

In practice, definite standard dimensions for the thickness of the spinning head insulation have been established. The reason for providing a sufficient thickness of the insulating jacket is to prevent the spinning block from cooling off and the spinneret temperature from falling below the product temperature because, in such event, the result would be a severe drop in tenacity and extension values of the filaments and, in the extreme case, a melt break of the capillaries.

From Great Britain Pat. No. 903,427, it is known to pass spun filaments of thermoplastic material through a duct of at least 1 meter in length arranged below the spinneret, at a temperature of 10° to 80° C. below the melting point, in order to obtain good textural yarn characteristics.

U.S. Pat. No. 4,134,882 discloses a high speed spinning process for polyester filaments at speeds of, or in excess of, 5000 m/min. Attention is called to the formation of a so-called core-skin structure of the capillaries as a result of intensive cooling of the filaments. This phenomenon is said to occur especially as the spinning speed increases. The ensuing structural inhomogeneities lead to poor processing properties in subsequent textile operations because of broken or breaking filaments. To avoid this effect, the state of the art proposes the use of a protective duct of a length of 70 to 100 mm to delay the cooling of the filaments. However, it has been found that such a measure will not produce satisfactory filament characteristics.

SUMMARY OF THE INVENTION

It is the object of the present invention to provide a process which will ensure high performance filament properties within a wide range of withdrawal speeds. Such properties are sought to ensure good titre and dyeability uniformity, tenacity and extension characteristics, while keeping the occurrence of disturbances during spinning and subsequent further processing to a minimum.

This object is achieved according to the process of the invention by selecting the distance between the uppermost blow point of the cooling zone and the underside of the spinneret plate (such distance being designated "D" in the following) so that the distance "D" is within a range which has for its upper limit the relation B and for its lower limits the relations $A_1$ or $A_2$ or $A_3$, respectively:

$$B=48.2(\log v)-109 \text{ (mm)}$$

$$A_1=34.4(\log v)-71 \text{ (mm)}$$

$$A_2=-32(\log v-3.356)^2+34 \text{ (mm)}$$

$$A_3=-44(\log v-3.221)^2+32 \text{ (mm)}$$

wherein "v" is the spinning speed (meter/min), and the following relations apply:

$A_1$ for a spinneret load $<0.5$ g/min/cm$^2$ $A_2$ for a spinneret load of 0.5–1.8 g/min/cm$^2$
$A_3$ for a spinneret load > 1.8 g/min/cm$^2$.

The boundaries of the regions defined by the foregoing relations may be represented by curves as shown in FIG. 1. The upper curve or limit is the same for all ranges. It has been found that a correlation exists with respect to the withdrawal speed v and the spinneret load, which will presently be further discussed.

The spinneret load is a readily reproducable condition. It is a value which is obtained from the polymer throughput through the spinneret per minute, divided by the size of the area over which the capillaries are distributed. The spinneret load has a bearing on the spinneret temperature. In the relevant literature, the spinneret temperature is frequently called the process defining spinning parameter. However, the temperature is not readily susceptible to measurements and is difficult to evaluate as to its effect on the spinning operation. In addition to the spinning load, the temperature also depends on other factors, such as the thermal conditions of the spinning head, the polymeric parameters and the cooling conditions.

For each speed v, an upper limit is clearly defined by the curve B. The pertinent lower limit, then depends on the spinneret load. For a spinneret load smaller than 0.5 g/min/cm$^2$, the distance "D" must not be allowed to be smaller than the corresponding value of the $A_1$ curve; for a spinneret load of 0.5 to 1.8 g/min/cm$^2$, the distance "D" must not be smaller than the corresponding value of the $A_2$ curve, and for a spinneret load greater than 1.8 g/min/cm$^2$, the distance "D" must not be smaller than the corresponding value of the $A_3$curve.

The process according to the invention has the advantage that, within the range defined for the distance "D" by the relations set forth above, tenacity and extension values of the filaments are obtained which are clearly acceptable for subsequent processing of the filament strands. A common reference value for the extension behavior is obtained as the product of the breaking load and the root of the elongation at break ($\sigma$=breaking load$\times\sqrt{\text{elongation at break}}$). These properties of the filaments can be determined with a conventional shredder. Comparing the value $\sigma_K$ of filaments produced according to conventional spinning processes with the value $\sigma_E$ of filaments produced according to the invention, it will be noted that $\sigma_E$ is in the range of $\sigma_K-20\%$ rel. to $\sigma_K+20\%$ rel. By adjusting the distance "D" to below the lower limit $A_1$ or $A_2$ or $A_3$, all else being equal, $\sigma$ values of filaments are obtained which are more than 20% lower than $\sigma_K$.

It has surprisingly been found that, in the process according to the invention, the filaments have extension properties which are readily acceptable for subsequent textile processing. At the same time, titre or tex variations are minimized and the uniformity of dyeability of the yarns is excellent, giving results which by far surpass the results obtainable with conventional methods. The spinning process and the yarn purity are impeccable.

These results are the more surprising as previous theoretical model calculations at best ascribe only secondary effects to the thickness of the spinning head insulation relative to the length of the path at which the filaments are cooled by blown air. Thus, the prior teachings may even lead to greater thickness of the spinning head insulation for the purpose of preventing a cooling of the spinneret by the blown air and by radiation.

The reduction of titre variations to a minimum and the outstanding dye uniformity are properties which also have a favorable bearing on the finished product, the woven or non-woven fabric or web. Such quality criteria of the textile product are highly appreciated by manufacturers and consumers alike.

The upper limit of the spinning withdrawal speed is not set by technological considerations; the basic principles are transferable also to a range above 6000 m/min. The suggested speed has in fact been realized with commercially available winding machines. The yarn speed at the first godet or, if winding is done without the use of godets, the yarn speed at the windup system, is designated as the spinning speed or withdrawal speed.

In the process of the invention, a multiplicity of synthetic substances may be used in the form of pure polymers or copolymers or polymers with additives for modifying the delustration, the dying, the electrostatic properties, etc. The invention process is preferably applicable to polyester, polyamide 6 and polyamide 66.

Moreover, the process according to the invention is suitable for yarns and fiber strands within a wide titre range, with filament thicknesses between 0.5 and 150 dtex and yarn thicknesses between 10 and 20,000 dtex. The process of the invention is also employed to good advantage for very fine filament and yarn titres as required by the textile industry, and for very strong yarn titres for use in the manufacture of staple fibers.

The invention further relates to an apparatus for melt-spinning of synthetic polymers to filaments. The apparatus comprises a heater (spinning head), with at least one spinneret having a lower, substantially planar spinneret surface, and a blowing duct including an uppermost blow point, a moistening and preparation plant and a withdrawal assembly designed for withdrawal speeds of between 600 and 6000 meters/min. Such an apparatus is further characterized according to the invention by setting the distance "D" of the uppermost blow point in the blowing duct from the lower spinneret surface so that it is within a range which is defined by an upper limit B and by lower limits $A_1$ or $A_2$ or $A_3$, as follows:

$$B=48.2(\log v)-109 \text{ (mm)}$$

$$A_1=34.4(\log v)-71 \text{ (mm)}$$

$$A_2=-32(\log v-3.356)^2+34 \text{ (mm)}$$

$$A_3=-44(\log v-3.221)^2+32 \text{ (mm)}$$

wherein "v" is the spinning withdrawal speed in m/min and the following relations apply:
$A_1$ for a spinneret load < 0.5 g/min/cm$^2$
$A_2$ for a spinneret load 0.5–1.8 g/min/cm$^2$
$A_3$ for a spinneret load > 1.8 g/min/cm$^2$ The invention will be described in further detail with reference to a preferred embodiment illustrated in FIGS. 1–3 and further with reference to several process examples given hereinafter. The essential process parameters and performance criteria of all of the process examples are summarized in Table 1. Table 1 also contains numerical textural data of the spun filaments.

BRIEF DESCRIPTION OF THE DRAWINGS

FIG. 1 is a graph of curves $A_1$, $A_2$, $A_3$ and B, with the abscissa representing the spinning withdrawal speeds in meters/min, and the ordinate representing the distance "D" in millimeters.

FIG. 2 is a top plan view of a spinneret with the spinneret plate viewed from the direction of the filaments being withdrawn.

FIG. 3 is a schematic representation of a spinning apparatus for carrying out the process of the invention.

DETAILED DESCRIPTION OF THE PREFERRED EMBODIMENTS

Referring to FIG. 1, the spaces between the curves B and $A_1$, between B and $A_2$ and between B and $A_3$ represent the regions within which the distance "D" must lie for each withdrawal speed. The numbers in parentheses refer to the numbers of the process examples and the comparative examples.

FIG. 2 shows a spinneret area 1 which is positioned within the boundary line containing all of the spinneret capillaries or orifices 2. The boundary line in this instance is a circle. Thus, the spinneret area is not identical with the spinneret plate 3 but is always smaller than the latter. The spinneret area 1 represents the magnitude which forms the quotient in the computation of the spinneret load.

FIG. 3 is a schematic, strongly simplified representation of a spinning machine. The molten polymer is forced in a predetermined quantity through a spinneret 4 having the desired number of orifices or capillaries 2 (see also FIG. 2). The spinneret 4 is constructed in the form of a plate, but is usually referred to simply as "spinneret."

The emerging filaments 5 drop through a space of a given height into a blowing duct 6 which forms a cooling zone in which the filaments are subjected to a transverse air current 7 and are cooled. After solidification, the filaments are passed through yarn guiding and preparation devices, not shown, and possibly also godets, and are finally wound up at predetermined speeds.

The spinneret 4 is a composite part of a spinneret assembly 8 which usually is also equipped with product distribution and filter units. The spinneret assembly 8 is enclosed within a heated spinning head 9 by which an intensive heat transfer to the spinneret assembly 8 is effected. The heat transfer surfaces extend up to and partly around the spinneret 4. To prevent heat loss, the spinning head 9 is provided with an insulating jacket 10. To prevent the spinneret 4 from losing heat, particularly by radiation, the spinneret 4 is slightly set back in the spinning head 9 and the spinning head insulating jacket 10. This so-called spinneret recess or retreat is desirable also for the reason that a direct passing by of cooling air at the spinneret surface 11 is avoided. Immediately below the spinning head insulation 10 is arranged a supporting plate 12 for the blowing duct 6 and a hood for the exhaust of vaporized polymer extract.

Immediately below the supporting plate 12 is located the highest blow point of the air flow 7. The distance "D" defined according to the invention is identical with the drop distance of the filaments from their point of emergence from the spinneret, i.e. the underside of the spinneret plate, to the level of the uppermost blow point. The space about the blow point is a quiescent zone, not subject to the blown air currents. It will be noted that the distance "D" is composed of the given recess in the spinning head 9, the thickness of the spinning head insulating jacket 10 and the thickness of the supporting plate 12 which may also be called a blowing duct collar. Thus, the distance "D" is not identical with any one of these components, but is always greater. While in accordance with the invention the distance"D" is required to lie within a certain range, the requirements as to the individual components should be considered separately. The recess in the spinning head 9 must be great enough to ensure a sufficient heating of the spinneret. The thickness of the spinning head insulating jacket 10 must be such that radiation losses are minimal and the thickness of the carrier plate 12 is determined by mechanical considerations. Consequently, a reduction in the depth of the recess or in the thickness of the spinning head insulation 10 to the extent of the length of the distance "D" will not suffice to obtain uniformly good filament properties when, in doing so, the length of the distance "D" is placed outside of the required range. Attention is called in this respect to Comparison Example No. 5.

EXAMPLE 1

Polyamide 66 having a relatve visocity $\eta_{rel}=2.45$ was melted at 293° C. and was passed at a rate of 9.6 g/min though a spinneret with seven orifices, each orifice having a diameter of 0.25 mm. The spinneret load was 0.7 g/min/cm$^2$. Having dropped through a space of length D=35 mm to the level of the uppermost blow point, cooling of the filaments was commenced by subjecting them to a transverse current of air having a speed of 0.4 m/sec. Subsequently, the cooled filaments were prepared and were withdrawn, without the use of a godet, at a speed of 3200 m/min and were wound up.

These filaments strands were capable of being draw-textured, without problem, with the normal titre of the finished yarn being 22f7 dtex. The textile characteristics of the spun filaments are given in Table 1. The titre uniformity (Uster) and the dyeability uniformity, judged by a sock knitted from such yarn, were excellent. Compared with and relative to a yarn made on a conventional spinning plant, the load extension reference value was 81%. While this value is still acceptable, it lies at the lower limit. The magnitude of the distance "D" was at the lower limit of the range assigned to the given spinning load.

EXAMPLE 2

PA-66 filaments were spun under the same conditions and the strands wound up as in Example 1. However, the drop distance of the filaments between spinneret plate and uppermost blow point was D=50 mm. Evenness of titre and dyeability of the filaments was excellent; the load extension reference value was 99% and thus was higher than in Example 1.

EXAMPLE 3

PA-66 filaments were spun and wound up under the same conditions as in Example 1, the difference being that the drop distance of the filaments from the spinneret plate to the uppermost blow point was D=60 mm. The uniformity values again were comparable to those of Example 2. Also the load extension reference value of 99% was the same as in Example 2.

EXAMPLE 4

(Comparison Example)

PA-66 filaments were spun and wound up under the same conditions as in Example 1, the difference being, that the drop distance of the filaments from the spinneret plate to the uppermost blow point was D=120 mm (conventional spinning plant). The titre and dyeability properties of the filaments were not tolerable.

Given the speed employed in this example, the distance "D" is outside the range as specified by the invention.

EXAMPLE 5

(Comparison Example)

PA-66 filaments were spun and wound up under the same conditions as in Example 1, except that the drop distance of the filaments between the spinneret plate and the uppermost blow point was D=80 mm. The thickness of the insulating jacket, i.e. the distance of the spinneret plate from the top surface of the supporting plate, was adjusted to 40 mm. Thus, while the thickness of the insulating layer was within the value range, the distance "D" was outside the limits set in accordance with the invention.

Titre uniformity was poorer than in the previous examples, and the dyeing was so streaky that these yarns were not acceptable.

EXAMPLE 6

Polyamide 6 having a relative visocity of $\eta_{rel}=2.38$ was melted at 265° C. and was spun at a rate of 33 g/min through a spinneret with 24 holes, each hole having a diameter of 0.25 mm. The spinneret load was 2.0 g/min/cm$^2$.

Having dropped through a distance D=60 mm to the level of the uppermost blow point, the filaments were cooled by subjecting them to the blowing action of a transverse current of air at a speed of 0.8 m/sec. The cooled filament strands were prepared and withdrawn at a speed of 6000 m/min and were wound up.

This yarn was capable of being draw-textured without problems. The nominal titre of the finished product was 78f24 dtex. Titre and dye evenness was flawless. The load extension reference value was about 100.5%.

EXAMPLE 7

(Comparison Example)

PA-6 filaments were spun under the same conditions as in Example 1, except that the filament strands were withdrawn at a speed of 1000 m/min and wound up. At this speed, the distance "D" is no longer within the range as specified by the invention. Titre and dye evenness of these filaments were no longer acceptable.

EXAMPLE 8

Polyester of a relative viscosity $\eta_{intr.}=0.64$ was melted at 300° C. and was spun at a rate of 28 g/min through a spinneret with 48 orifices, each orifice having a diameter of 0.25 mm. The spinneret load was 1.1 g/min/cm$^2$. Having dropped through a length D=35 mm to the level of the uppermost blow point, the filaments were cooled by subjecting them to the blowing action of a transverse air current at a speed of 0.5 m/sec. The cooled filament strands were prepared and withdrawn at a speed of 3200 m/min and wound up.

These yarns were capable of being draw-textured without problem. The nominal titre of the finished yarn was 56f48 dtex. The textile characteristics of the spun years are compiled in Table 1. Titre and dye evenness of the filament strands were impeccable. In comparison with and relative to a yarn produced on a conventional spinning plant, the load extension reference value was 107%. The distance "D" lies within the range specified by the process of the invention.

EXAMPLE 9

Polyester filaments were spun and wound up under the same conditions as in Example 8, except that the distance between the spinneret plate and the level of the uppermost blow point was D=120 mm (conventional spinning plant). This length was outside the value range as established by the invention. The evenness values obtained were not acceptable.

TABLE 1

| | Example No. | | | | | | | | |
|---|---|---|---|---|---|---|---|---|---|
| Invention/Comparison | 1 Invent. | 2 Invent. | 3 Invent. | 4 Compar. | 5 Compar. | 6 Invent. | 7 Compar. | 8 Invent. | 9 Compar. |
| Polymer | PA-66 | PA-66 | PA-66 | PA-66 | PA-66 | PA-6 | PA-6 | PET | PET |
| Nominal Titer (denier) (dtex) | 22f7 | 22f7 | 22f7 | 22f7 | 22f7 | 78f24 | 78f24 | 56f48 | 56f48 |
| Spinning withdrawal speed (m/min) | 3200 | 3200 | 3200 | 3200 | 3200 | 6000 | 1000 | 3200 | 3200 |
| Spinneret load (g/min/cm$^2$) | 0.7 | 0.7 | 0.7 | 0.7 | 0.7 | 2.0 | 2.0 | 1.1 | 1.1 |
| Magnitude "D" (mm) | 35 | 50 | 60 | 120 | 80 | 60 | 60 | 35 | 120 |
| Characteristics of the spun yarn: | | | | | | | | | |
| Uster (half inert) (%) | <0.5 | <0.5 | <0.5 | 0.75 | 0.95 | 0.5 | 1.0 | 0.5 | 1.4 |
| Evenness of dyeability* | + | + | + | − | − | + | − | + | − |
| (Break load × $\sqrt{\text{break elongation}}$ ) rel. (%) | 81 | 99 | 99 | 100 | 101.5 | 100.5 | − | 107 | 100 |

*Rating
+ very even
− severely streaky

We claim as our invention:

1. In a process for melt-spinning of synthetic polymers selected from the group consisting of polyamide 6, polyamide 66, polyester and their copolymers into filaments wherein the polymer is melt-spun through orifices, said orifices being located in a spinneret, said spinneret being of a substantially planar bottom surface, thereby forming said filaments, said filaments being allowed to emerge from said spinneret and drop into a blowing duct, said blowing duct having an uppermost blow point, said filaments being subjected to a current of air flowing in a direction normal to the filaments and cooled in a cooling zone, said cooling zone being located below said uppermost blow point, said filaments being moistened and prepared and then withdrawn at a speed of between 600 and 6000 meters/min., said uppermost blow point and said surface of said spinneret having a distance "D" therebetween and defining a quiescent zone, said distance "D" being selected so that said distance is within a range, said range having an upper limit and a lower limit, the improvement in which said upper limit is defined by a relation "B," wherein $B=48.2 (\log v)-109$ (mm), and said lower limit is defined by a relation $A_1$, $A_2$ or $A_3$ wherein $A_1=34.4(\log v)-71$ (mm) and applies to a spinneret load of less than 0.5 g/min/cm$^2$ $A_2=-32(\log v-3.356)^2+34$ (mm) and applies to a spinneret load of 0.5−1.8 g/min/cm$^2$ $A_3=-44(\log v-3.221)^2+32$ (mm) and applies to a spinneret load greater than 1.8 g/min/cm$^2$, wherein "v" is the spinning withdrawal speed in meters/min.

2. The process of claim 1, wherein said polymer is a polyester, said filaments having a capillary titre of less than or equal to 1.5 dtex and an overall titre of less than or equal to 230 dtex, said filaments being spun at a spinneret load of greater than or equal to 0.8 g/min/cm$^2$ and a spinning withdrawal speed of greater than or equal to 2800 meters/min, said distance "D" being selected in a range, said range extending between "B" and 35 mm.

3. The process of claim 1, wherein said polymer is a polyester, said filaments being of an overall titre of greater than or equal to 1100 dtex, said overall titre being at a spinneret load of greater than or equal to 1.8 g/min/cm$^2$ and a spinning withdrawal speed of greater than or equal to 1200 m/min, said distance "D" being selected in a range, said range extending between "B" and 31 mm.

4. The process of claim 1, wherein said polymer is a polyamide, said filaments being of an overall titre of 10–170 dtex, said overall titre being at a spinneret load of 0.5–1.8 g/min/cm$^2$ and a spinning withdrawal speed of greater than or equal to 4500 meters/min, said distance "D" being selected in a range, said range extending from ("B"−15) to $A_2$.

5. The process of claim 1, wherein said filaments in said cooling zone are guided over guide members or filament abrasion members.

6. The process of claim 1, wherein said filaments, upon leaving said cooling zone, are subjected to an additional drawing and/or temperature treatment.

* * * * *